US005351815A

United States Patent [19]

Fogle et al.

[11] Patent Number: 5,351,815

[45] Date of Patent: Oct. 4, 1994

[54] NECK CLIP BOTTLE CARRIER FOR TWO ROWS OF BOTTLES

[75] Inventors: James C. Fogle, Atlanta; Robert L. Sutherland, Kennesaw, both of Ga.

[73] Assignee: Riverwood International Corporation, Atlanta, Ga.

[21] Appl. No.: 123,552

[22] Filed: Sep. 20, 1993

[51] Int. Cl.[5] ..... B65D 75/00

[52] U.S. Cl. ..... 206/153; 206/147; 206/158; 206/162; 294/87.2

[58] Field of Search ..... 206/145, 147, 151, 152, 206/153, 158, 161, 162, 194; 294/87.2

[56] References Cited

U.S. PATENT DOCUMENTS

| | | | |
|---|---|---|---|
| 2,397,716 | 4/1946 | Wendler | 294/87.2 |
| 2,737,326 | 3/1956 | Toensmeier | 206/158 |
| 3,016,259 | 1/1962 | Lawrence | 206/153 |
| 3,123,213 | 3/1964 | Kulig | 206/158 |
| 3,387,879 | 6/1968 | Wood | 206/158 |
| 3,404,912 | 10/1968 | Watts | 294/87.2 |
| 3,528,697 | 9/1970 | Wood | 294/87.2 |
| 4,244,617 | 1/1981 | Manizza | 206/153 |
| 4,250,991 | 2/1981 | Manizza et al. | 206/153 |
| 4,305,500 | 12/1981 | Jaeschke | 294/87.2 |
| 4,318,476 | 3/1982 | Wood et al. | 206/153 |
| 4,326,628 | 4/1982 | Wood | 206/153 |

FOREIGN PATENT DOCUMENTS

| | | | |
|---|---|---|---|
| 2038764 | 7/1980 | United Kingdom | 206/147 |

*Primary Examiner*—David T. Fidei

[57] ABSTRACT

A neck clip carrier comprised of two carrier units separated by a handle structure. Each carrier unit is comprised of a bottom panel and two angled side panels. The bottom panels and side panels contain openings for receiving two bottles, the lower edge of the side panel openings engaging the underside of the bottle flanges to support the bottles. The handle structure comprised of spaced panels hinged together at their upper edges, and the bottom and side panels of the carrier units are of two-ply construction. Tear strips may be provided in the plies of the outer side panels to facilitate access to the bottles. The carrier is formed from a single blank of material.

10 Claims, 3 Drawing Sheets

NECK CLIP BOTTLE CARRIER FOR TWO ROWS OF BOTTLES

FIELD OF THE INVENTION

This invention relates to bottle carriers of the neck clip type, wherein bottles are supported at their necks by an elongated tube-like carrier. More particularly, it relates to a neck clip carrier capable of supporting two rows of bottles.

BACKGROUND OF THE INVENTION

Neck clip carriers are economical carriers commonly used to carry beverage bottles, particularly large plastic bottles which are formed with a flange or collar on the neck just below the bottle cap. Openings in the bottom of the carrier permit the carrier to be moved down over the tops of the bottles to be packaged. The lower edges of openings in the side panels of the carrier engage the underside of the bottle flanges and support the bottles during lifting and carrying.

Normally, neck clip carriers are designed to carry two or three bottles arranged in a single row. Carriers designed to carry two bottles are typically provided with finger holes in the side panels between the bottles. In this location the finger holes can readily be grasped and the bottles balanced when the carrier is lifted. For carriers designed to carry three bottles, an integral handle panel extending above the middle bottles may be provided. The handle makes it easier to carry the heavier three-bottle load and overcomes the problem of where to locate finger holes which normally would be located in the space occupied by the middle bottle. Even though the packaged bottles may be quite large and heavy, such as two-liter beverage bottles, neck clip carriers of the type described are capable of adequately supporting them during lifting and carrying.

Problems are encountered in attempting to use similar neck clip carriers to package four large bottles. The extra weight of the fourth bottle plus the additional carrier length produce forces at the ends of the carrier that are difficult to resist using conventional carrier designs and conventional paperboard material. Also, the weight distribution of four linearly arranged bottles would make such carriers unwieldy and very heavy to carry.

It is an object of the invention to provide a neck clip carrier which overcomes the problems encountered in packaging four or more large bottles.

BRIEF SUMMARY OF THE INVENTION

The neck clip bottle carrier of the invention comprises two similar neck clip carrier units spaced from each other by a central handle structure to which the carrier units are connected. Each carrier unit includes a bottom panel and side panels angled upwardly toward each other from opposite ends of the bottom panel. The bottom and side panels contain openings for receiving the necks of bottles. The openings in the side panels include lower edges for engaging the underside of outwardly extending flanges on the necks of the packaged bottles to support the bottles in the carrier. Each neck clip carrier unit includes openings for supporting at least two bottles.

Preferably, the bottom and side panels of each carrier unit are comprised of inner and outer plies of material, which adds to the strength of the carrier, with the separate panels of the handle structure being connected to the outer bottom panel ply of both neck clip units. To enable such a structure to be formed from a single blank of material, the panel sections forming the plies of the panels are sequentially foldably connected as explained more fully below. Handle openings in the handle panels enable the carrier to be lifted, and tear strips in the outer side panel provide access to the bottles.

The carrier is economical to produce, yet can readily support very heavy loads, such as the loading produced by four two-liter beverage bottles. The above and other aspects and benefits of the invention will be more apparent from the detailed description of the preferred embodiment of the invention which follows.

DETAILED DESCRIPTION OF THE PREFERRED EMBODIMENT

Figure 1:
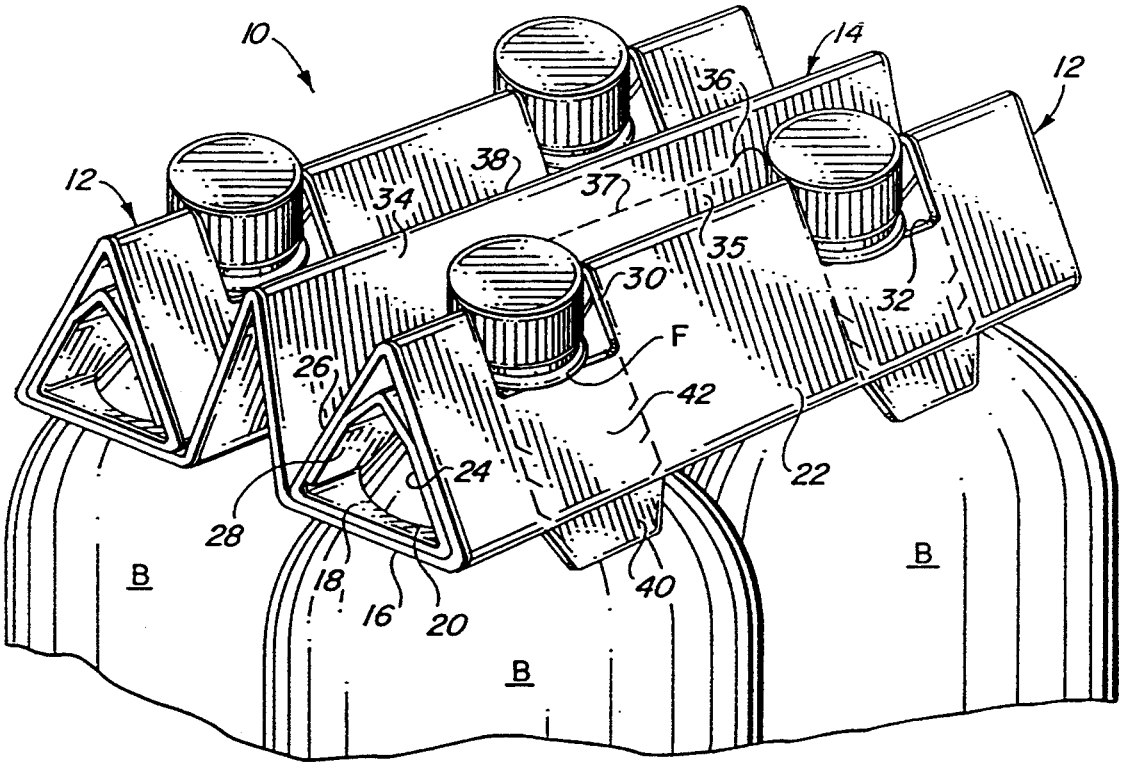
FIG. 1 is a pictorial view of the neck clip carrier of the invention, shown in connection with a four-bottle package.
Figure 2:
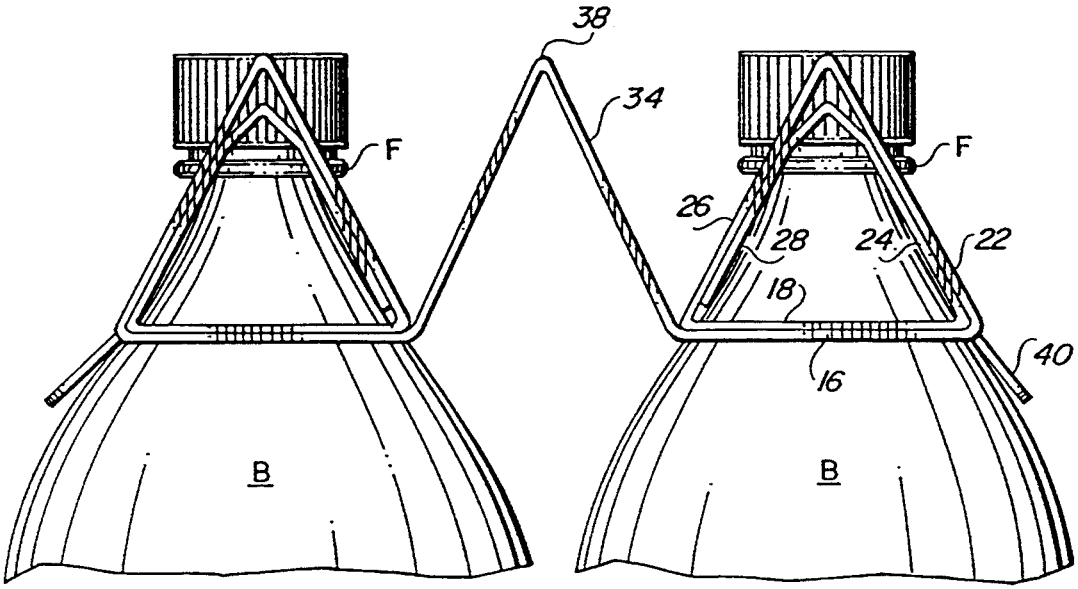
FIG. 2 is an enlarged partial end view of the neck clip carrier of FIG. 1.
Figure 3:
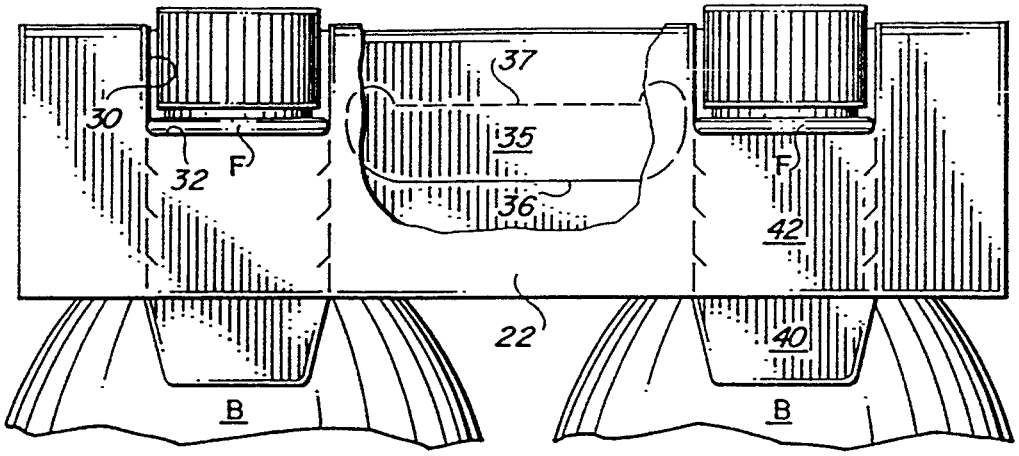
FIG. 3 is an enlarged partial side view of the neck clip carrier.

Referring to FIGS. 1, 2 and 3, the neck clip carrier 10 is illustrated in connection with a four-bottle arrangement. The carrier comprises two spaced elongated neck clip carrier units 12 connected to a central handle 14. Each carrier unit is of basic neck clip type of construction, including a bottom panel containing cutouts through which the bottles B extend and angled side panels. The side panels contain cutouts, the lower edges of which engage the underside of flanges F of the bottles when the carrier is lifted, thereby supporting the bottles. In accordance with the invention, the bottom panel of each carrier unit is of two-ply construction, comprising an outer ply 16 and an inner ply 18. Each contains two bottle cutouts in register with the cutouts in the other ply. Only the near end cutouts 20 in the inner ply of the carrier units are visible in FIG. 1. The side panels are also of two-ply construction, wherein the outer facing side panel is comprised of outer ply 22 and inner ply 24 and the inner facing side panel is comprised of outer ply 26 and inner ply 28. The bottle flange support edges are formed by cutouts in both the inner and outer plies of the side panels. Only the cutouts 30 and the support edges 32 in the outer ply 22 of the outer side panel are visible in FIGS. 1 and 3.

The handle 14 is comprised of angled handle panels 34, each of which contains a handle opening 36 covered by a flap 35 connected to the panel by fold line 37. The handle panels are connected to each other along fold line 38 and to the outer ply 16 of the bottom panel of the neck clip units 12. Tabs 40 extend from tear strips in the inner plies 24 of the outer side panels, while tear strips 42 in the outer ply 22 of the outer side panels overlie the inner tear strips to facilitate removal of the bottles.

Figure 4:
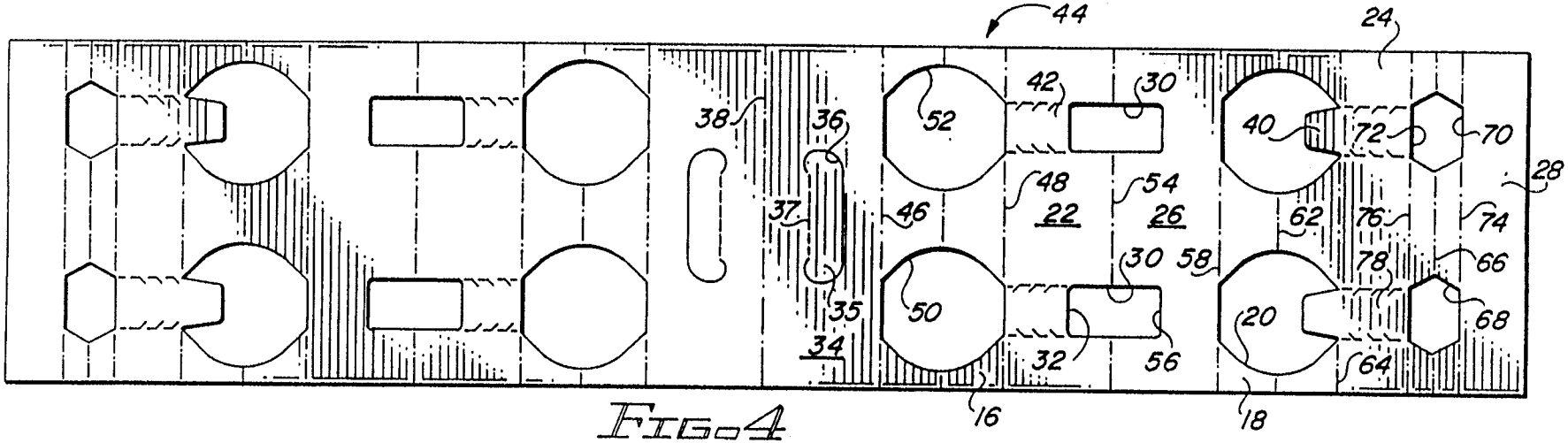
FIG. 4 is a plan view of a blank used to form the carrier.

Referring now to FIG. 4, wherein like reference numerals to those used in FIGS. 1, 2 and 3 refer to similar elements, a blank 44 used to form the neck clip carrier of FIG. 1 is comprised of a rectangular sheet of flexible, foldable material such as conventional paperboard used in the carrier industry. The elements forming each neck clip carrier unit are symmetrically arranged on either side of the handle panel sections 34, and the fold line 38 separating the handle panel sections is at the centerline of the blank. The handle openings 36 and flaps 35 are equally spaced from the fold line 38.

The outer bottom panel section 16 of each unit is connected to the adjacent handle panel section 34 along fold line 46 and to the outer side panel section 22 along fold line 48. Cutouts 50, for receiving the upper portions of the bottles, are provided in the outer panel section 16. Edges of the cutouts 50 coincide with the fold lines 46 and 48, causing these fold lines to be interrupted. A fold line 52 in the bottom panel section 16 is parallel to the fold lines 46 and 48 and extends along the centerline of the bottom panel section.

The outer side panel section 22 is connected to the outer ply section 26 by fold line 54, which is interrupted by the cutouts 30 that bridge the panel sections 22 and 26. Each cutout 30 includes a bottle flange support edge 56 opposite the support edge 32. The tear strips 42 in the outer side panel section 22 extend from the end of the cutouts 30 to the edge of the bottle cutouts 50.

Connected to the outer side panel section 26 along interrupted fold line 58 is the inner bottom panel section 18 which, similar to the outer bottom panel section 16, includes the bottle cutouts 20 and a central fold line 62. The bottom panel section 18 is connected to the inner side panel section 24 by fold line 64 and the inner side panel section 24 is connected to the inner side panel section 28 by fold line 66. Cutouts 68 bridge the inner side panel sections 24 and 28 and provide bottle support edges 70 and 72 in the panel sections 28 and 24, respectively. The panel sections 28 and 24 include fold lines 74 and 76, respectively, which extend parallel to the fold line 66 and are interrupted by the angled edges of the cutouts 68. Tear strips 78 in the inner side panel section 24 extend from the ends of the cutouts 68 beyond the fold line 64, terminating within the cutouts 20 to form the tabs 40.

Still referring to FIG. 4, it should be kept in mind that the surface of the handle panel sections seen in the blank of FIG. 4 forms the outer faces of the handle panels of the carrier, while the surface of the other sections seen in the blank forms the interior faces of those panels. To form the carrier, the inner side panel sections 28 are folded about the fold line 66 to the position shown in FIG. 5. The dimensions of the inner and outer side panel sections 28 and 26 are such that the end of the inner side panel section 28 is slightly spaced from the fold line 64 so as not to interfere with subsequent folding about the fold line 64. It will be understood that although only half of the blank is shown in FIG. 5 and in the succeeding drawing figures which illustrate the formation of the carrier, identical folding and gluing steps will be taken in the other half.

Figure 5:
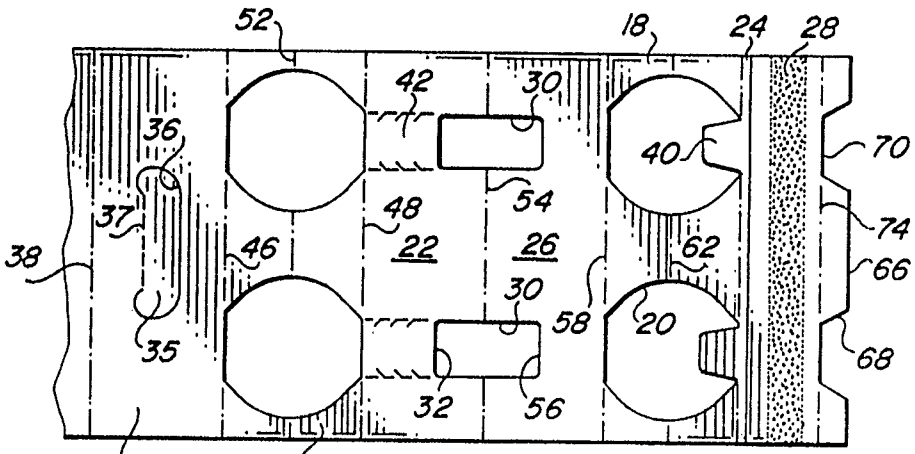
FIG. 5 is a partial plan view of the blank of FIG. 4, showing one side of the blank after it has been folded to an initial stage during formation of a carrier.

Adhesive is applied to the exterior face of the panel section 28, as illustrated in stipple in FIG. 5, and the portion of the blank to the right of the central fold line 62 of the inner bottom panel section 18 is folded about the fold line 62. The folded panel section 28 moves with the folded portion of the blank as a unit, so that the adhesive applied to the face of the panel section 28 contacts and is adhered to the outer side panel section 26 in the area between the cutouts 30 and the fold line 58. The blank at this interim stage of fabrication is illustrated in FIG. 6.

Figure 6:
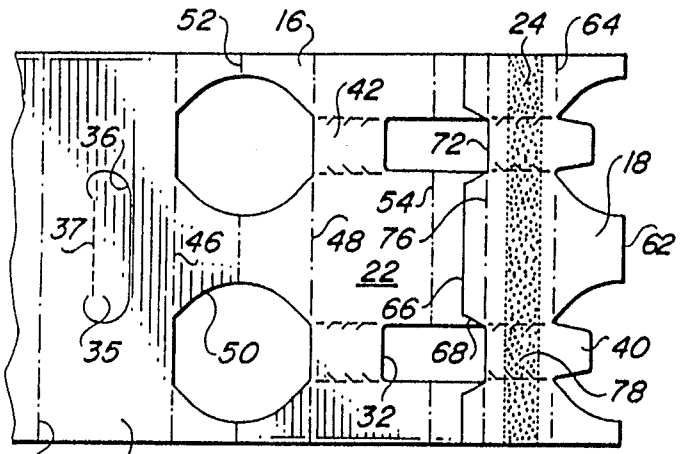
FIG. 6 is a partial plan view similar to that of FIG. 5, but showing the blank at an intermediate stage in the formation of a carrier.

Adhesive is then applied to the exterior face of the panel section 24, as illustrated in stipple in FIG. 6, and the portion of the folded blank to the right of fold line 54 is folded about the fold line 54. This brings the adhesive on the face of panel section 24 into contact with the panel section 22 in the area between the cutouts 30 and the fold line 48. The blank at this further interim stage of fabrication is illustrated in FIG. 7.

Figure 7:
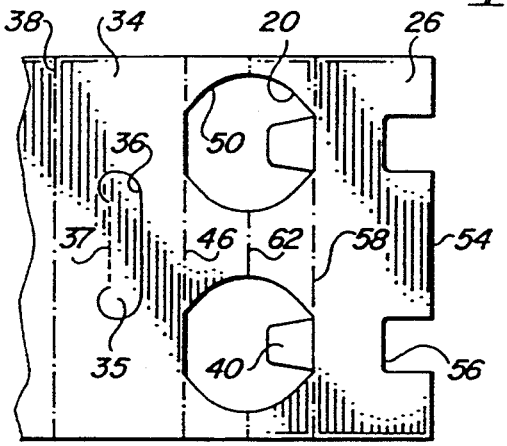
FIG. 7 is a partial plan view similar to that of FIG. 6, but showing the blank at a further intermediate stage in the formation of a carrier.
Figure 8:
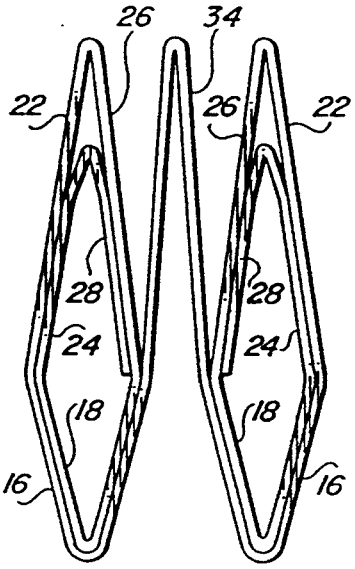
FIG. 8 is an end view of the carrier prior to being installed on bottles.

The blank of FIG. 7 is then folded about the fold lines 52, bringing the outer face of the panel section 26 into contact with the outer face of the handle panel section 34. The blank at this stage is fully collapsed and folded into a flat multilayered unit which can readily be shipped and handled in this configuration. The slightly unfolded collapsed blank is shown in FIG. 8, and can be further unfolded to the degree necessary to align it with a group of bottles to be packaged.

When installing the carrier, the bottles are aligned with the aligned openings 20 and 50 in the bottom panel sections 18 and 16 and the collapsed carrier blank is pushed down over the bottle necks. The bottle necks thus move up through the bottom panel openings 20 and 50 in the bottom panel sections and through the aligned openings 30 and 68 in the inner and outer side panel sections. The fold lines 52 and 62 in the bottom panel sections 16 and 18 and the fold lines 74 and 76 in the inner side panel sections 28 and 24 allow the side panels to flex away from each other as the bottles move up and force them out. Relative movement between the bottles and the carrier is continued until the flanges F on the bottles pass the lower aligned locking edges 32 and 72 in the outer side panel sections and 56 and 70 in the inner side panel sections, thereby allowing the side panels to snap into position beneath the flanges. This final locking arrangement is illustrated in FIGS. 1, 2 and 3.

It will be noted in FIG. 2 that the apex of the inner side panel sections 24 and 28 is spaced from the apex of the outer side panel sections 22 and 26. This is a result of the width of the inner side panel sections 24 and 28 in the blank shown in FIG. 4 being less than the width of the outer side panel sections 22 and 26, which enables the outer panel sections 22 and 26 to be folded into flat collapsed condition without interference from the fold line 66 of the inner side panel sections 24 and 28. Although the outer and inner plies of the side panels may not be in contact in the area above the support edges of the side panel cutouts, they are in contact at and below the cutout support edges, thereby providing two-ply support in the areas receiving the lifting and carrying stresses.

Figure 9:
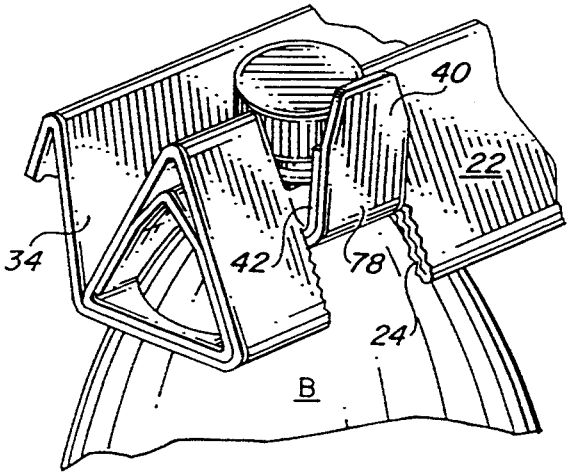
FIG. 9 is a partial pictorial view of the carrier, illustrating use of a tear strip for providing access to an adjacent bottle.

As previously mentioned, the tear strips in the inner and outer side panel sections are aligned to allow easy access to the bottles. As shown in FIG. 3, the tab 40 of the tear strips 78 in the inner side panel section 24 extends below the tear strip 42 in the outer side panel section 22. By pulling up on the tab 40, both tear strips 78 and 42 are separated from their side panel sections. The tear strips are illustrated in FIG. 9 as they appear while in the process of being separated. When fully separated, the neck of the associated bottle can readily be moved out of the adjacent cutout and removed from the carrier.

Figure 10:
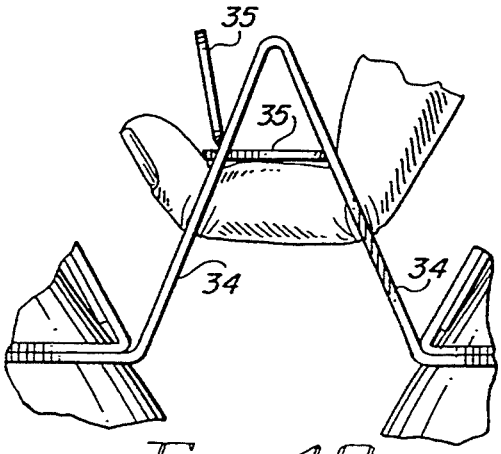
FIG. 10 is a partial end view of the carrier handle in the grasp of a user.

The handle panels enable the carrier to be lifted through the handle openings in both panels. As shown in FIG. 10, the handle panels of the finished carrier remain separated, angled apart both at rest and when being lifted and carried. When a person grasps the panels through their openings, the flap 35 of the first handle panel encountered pivots under between the panels and provides a horizontal support for the hand, protecting the hand against the edges of the openings. The resulting triangular handle configuration is very strong and resistant to tearing at this critical area.

Although the invention has been illustrated in connection with bottles having flanges located at a point below the cap, it will be understood that the principles of the neck clip carrier apply to other bottle designs as well, as long as they have a flange-like projection or shoulder which the locking edges of the cutouts can engage.

It should now be appreciated that the carrier of the invention provides a number of advantages. It combines the economy of a neck clip design with the ability to support two rows of four or more heavy bottles. The individual spaced carrier units are connected by the handle panels and are of two-ply construction for rigidity and strength. Further, the carrier is formed from a single rectangular blank by means of conventional folding and gluing procedures. Despite the heavy load of the bottles, their close concentration in the carrier and the centering of the handle between the bottles makes lifting and carrying the package unexpectedly convenient.

It should be apparent that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A neck clip bottle carrier, comprising:
a central handle structure connected to spaced neck clip carrier units on either side thereof;
each carrier unit including a bottom panel having openings therein for receiving the necks of bottles and side panels angled upwardly toward each other;
upper portions of the side panels containing openings for receiving the necks of bottles, the openings including lower edges for engaging the underside of outwardly extending flanges on the bottle necks to support the bottles in the carrier;
the bottom and side panel of each carrier unit being comprised of inner and outer plies of material; and
the handle structure being comprised of opposite panels connected to each other along a fold line, each handle panel being connected to the outer bottom panel ply of an adjacent neck clip unit.

2. A neck clip bottle carrier as defined in claim 1, wherein the side panels of each neck clip unit are comprised of an outer side panel and an inner side panel located between the outer side panel and the handle structure, the outer ply of the bottom panel of each carrier unit being connected by a fold line to the outer ply of the outer side panel.

3. A neck clip carrier as defined in claim 2, wherein the inner and outer plies of the outer side panels contain aligned tear strips beneath the bottle neck openings therein.

4. A substantially rectangular blank for forming a neck clip bottle carrier, comprising:
two central handle panel sections connected by a fold line to each other;
each handle panel section being connected by a fold line to a bottom panel section;
each bottom panel section being connected by a fold line to a first side panel section;
each first side panel section being connected by a fold line to a second side panel section;
each bottom panel section having openings therein for receiving the necks of bottles; and
each side panel section having openings therein for receiving the necks of bottles, the openings in the side panel sections including lower edges for engaging the underside of outwardly extending flanges on the bottle necks in a carrier formed from the blank to support the bottles in the carrier.

5. A neck clip bottle carrier blank as defined in claim 4, wherein each bottom and side panel section includes openings for supporting two bottles.

6. A neck clip bottle carrier blank as defined in claim 4, wherein each second side panel section is connected by a fold line to a second bottom panel section, each second bottom panel section is connected by a fold line to a third side panel section and each third side panel section is connected by a fold line to a fourth side panel section.

7. A neck clip bottle carrier blank as defined in claim 4, wherein the handle panel sections contain handle openings adapted to be oppositely located in a carrier formed from the blank.

8. A neck clip bottle carrier blank as defined in claim 4, wherein each handle panel section includes a hinged flap at least partially covering the handle opening therein, the flaps having a width capable of extending from one handle panel section to the other when folded under during lifting of a carrier formed from the blank.

9. A neck clip bottle carrier blank as defined in claim 6, wherein the first and third side panel sections contain tear strips extending from the bottle neck openings therein, the tear strips being aligned in a carrier formed from the blank.

10. A neck clip bottle carrier, comprising:
a central handle structure connected to spaced neck clip carrier units on either side thereof;
each carrier unit including a bottom panel having openings therein for receiving the necks of bottles and side panels angled upwardly toward each other;
upper portions of the side panels containing openings for receiving the necks of bottles, the openings including lower edges for engaging the underside of outwardly extending flanges on the bottle necks to support the bottles in the carrier;
the bottom and side panel of each carrier unit being comprised of inner and outer plies of material;
the handle structure being connected to the outer bottom panel ply of both neck clip units;

the side panels of each neck clip unit being comprised of an outer side panel and an inner side panel located between the outer side panel and the handle structure, the outer ply of the bottom panel of each carrier unit being connected by a fold line to the outer ply of the outer side panel; and the outer ply of the outer side panel of each carrier unit being connected by a fold line to the outer ply of the inner side panel, the outer ply of the inner side panel being connected by a fold line to the inner ply of the bottom panel, the inner ply of the bottom panel being connected by a fold line to the inner ply of the outer side panel, and the inner ply of the outer side panel being connected by a fold line to the inner ply of the inner side panel.

* * * * *